US005925193A

United States Patent [19]

Bude et al.

[11] Patent Number: 5,925,193

[45] Date of Patent: Jul. 20, 1999

[54] METHOD FOR CLEANING PRE-DETERMINABLE SURFACES OF A HEATABLE INTERNAL CHAMBER AND ASSOCIATED WATER LANCE BLOWER

[75] Inventors: Friedrich Bude, Cottbus; Karl Albers, Wesel; Stephan Simon, Hamminkeln, all of Germany

[73] Assignee: Clyde Bergemann GmbH, Wesel, Germany

[21] Appl. No.: 08/979,727

[22] Filed: Nov. 26, 1997

Related U.S. Application Data

[63] Continuation of application No. PCT/EP96/02323, May 30, 1996.

[30] Foreign Application Priority Data

May 30, 1995 [DE] Germany ..... 195 19 780

[51] Int. Cl.[6] ..... B08B 3/02; B08B 9/00; B08B 9/093; B08B 9/04

[52] U.S. Cl. ..... 134/18; 134/22.1; 134/22.12; 134/22.18; 134/8; 134/167 R; 134/24

[58] Field of Search ..... 134/22.1, 22.12, 134/22.18, 8, 24, 167 R, 168 R, 57 R, 18

[56] References Cited

U.S. PATENT DOCUMENTS 4,539,588 9/1985 Ariessohn et al. ..... 358/113

FOREIGN PATENT DOCUMENTS

| | | |
|---|---|---|
| A-637-931 | 5/1928 | France . |
| 600 827 | 7/1934 | Germany . |
| 145 475 | 12/1980 | Germany . |
| 145 476 | 12/1980 | Germany . |
| 155 857 | 7/1982 | Germany . |
| 33 43 992 C2 | 12/1983 | Germany . |
| 234-479-A1 | 4/1986 | Germany . |
| 239-656-A1 | 10/1986 | Germany . |
| 276-335-A1 | 2/1990 | Germany . |
| 276-908-A1 | 3/1990 | Germany . |
| 281-448-A5 | 8/1990 | Germany . |
| 281-452-A5 | 8/1990 | Germany . |
| 281-468-A5 | 8/1990 | Germany . |
| 41 39 718 A1 | 12/1991 | Germany . |
| 41 39 838 A1 | 12/1991 | Germany . |
| 41-42-448 A1 | 12/1991 | Germany . |
| 44 15 010 A1 | 4/1994 | Germany . |
| WO 93/12398 | 6/1993 | WIPO . |

OTHER PUBLICATIONS

International Search Report PCT/EP96/02323.
Preliminary Examination Report PCT/EP96/02323.
Stein, Dipl.–Ing. J., Induktives Wegmesssystem, *Steuerungs–Und Regelungstechnik,* 1988, No. 10, pp. 702–704.

*Primary Examiner*—Zeinab El-Arini
*Attorney, Agent, or Firm*—Frohwitter

[57] ABSTRACT

A method for determining positioning of a controllable blower lance for cleaning a pre-determinable surface of a heatable internal chamber, preferably a combustion chamber, in which deposits form, wherein at least one site of impact of a cleaning medium of the blower lance on a surface to be cleaned of the internal chamber and at least one position of at least a part of the blower lance, by means of which the direction of flow of the cleaning medium out of the blower lance can be determined, are established and recorded and a correlation is established between at least the site of impact and the position, taking into account at least one parameter concerning the internal chamber, wherein by means of the correlation, the positioning of the blower lance can be determined for cleaning the pre-determinable surface. Furthermore a method and a device are provided for cleaning an internal chamber, preferably of a combustion chamber in which deposits form, with a controllable blower lance, the cleaning medium of which must strike a pre-determinable surface to be cleaned of the internal chamber, wherein a pre-determinable control system of the blower lance is superimposed with a correlation associated with the condition in the internal chamber and/or the condition of the cleaning medium, such that the pre-determinable surface to be cleaned is struck according to plan by the cleaning medium whatever the conditions in the internal chamber. Undesired shifting of the cleaning jet of a blower lance, caused by different operating conditions in the internal chamber, can be compensated for in this way.

28 Claims, 5 Drawing Sheets

METHOD FOR CLEANING PRE-DETERMINABLE SURFACES OF A HEATABLE INTERNAL CHAMBER AND ASSOCIATED WATER LANCE BLOWER

CONTINUATION STATEMENT

This is a continuation of International Application Number PCT/EP96/02323 designating the United States, filed 30 May 1996, still pending.

BACKGROUND OF THE INVENTION

The present invention relates to a method for cleaning pre-determinable surfaces of a heatable internal chamber, preferably of a combustion chamber, in which deposits form. The invention further relates to a blower lance which can be used for this method. A main area of application of the invention is the cleaning of power station boilers.

During in-service cleaning of clinkered or soiled heating surfaces in combustion chambers, water lance blowers which are arranged in an aperture are used to blow a compact water jet through the flames and the combustion chamber onto the wall opposite or to the side, and clean the walls by the shock effect of the water. Such water lance blowers are disclosed in DD 145 476 and DD 155 857. With this, the water lance implements a blowing pattern which can have the widest variety of geometry; For example, spirals (DD 145 476) or wave-form bands (DD 155 857). The water jet leaving the water lance blower then implements a cleaning pattern on the wall which the water jet strikes. The blowing path is controlled by control means for moving the water lance, which is mounted at its front area to a fixed point on the combustion chamber aperture and is guided on its rear bearing by means of path and/or time control of the lance guidance. In P 44 15 010.5, a control system is disclosed wherein with every working step a fixed reference point or site is started at, and thereby the same location for the initial position of the water lance for carrying out the blowing pattern is ensured. Any possible tolerances occurring in the control system are in this way levelled out so that no changes in the path occur. Different blowing patterns which also avoid apertures of, for example, burners and smoke recirculators, for the widest variety of surface areas and sizes of the wall surface to be cleaned, are allocated to a blower lance, and selectively commanded to perform the blowing operation.

It is further known from DE 195 19 748.8 A1, DE 195 19 780.1 A1 and DE 195 19 790.1 A1 to locally allocate the coordinates of the water lance positions to the geometrical arrangements of the wall surfaces. In this way each point of the wall surface struck by a geometric jet by the blower lance is allocated a blower lance coordinate.

There are also methods according to the prior art in which selection of the blowing pattern and of its blowing intensity is determined according to the degree of soiling of the wall surface. In DD 281 448, DD 281 452 and DD 281 468 methods are disclosed for control of water lance blowers and for sensing clinkered areas on heating surfaces in combustion chambers of coal powder furnaces. DD 281 448 describes a method for control of a water lance blower for cleaning heating surfaces, wherein reference images are generated by an optical probe which is connected to a camera and a measuring system. These are divided into fields using coordinates of the measuring system, and are characterised by signals. During the operation of the combustion chamber real-time images are generated and compared to the reference images. From the comparison, a clinkered area is determined and a command signal is produced from coordinates of known blowing patterns of the water lance blower, which controls the water lance blower for cleaning the clinkered area. A known blowing pattern can be determined using any manually controlled method for the water lance blower, while observing the water jet on a screen. DD 281 452 discloses a method wherein a water lance blower is steered to the clinkered area determined using known, memorised coordinates of blowing patterns of a water lance blower. In this way the area to be cleaned is delimited in terms of its area and periphery. In DD 281 468, the selection of the operation of the water lance blower is concentrated on selected cleaning areas according to the degree of soiling. In this case recording, summation and subsequent evaluation of the cleaning result is provided. In all these methods a geometrically defined water jet is assumed.

In an analogous manner to the method according to DD 281 468, in DE 41 39 838 the degree of emission of cleaned and soiled and clinkered furnace walls is measured by emission measuring means, compared with set values and from this commands are derived for the blowing rhythm and the blowing intensity with respect to the speed of the blown jet of a water lance blower. This solution is used for coals with thin, white, glossy or shining ashes or deposits. In accordance with DE 41 39 718 A1 and U.S. Pat. No. 4,539,588 an infra-red video image is generated for employing this method, which simultaneously compares the local radiation intensity of pre-determined soiled and clean furnace chamber measuring surfaces. This comparison is based on results of measurements by photo-detectors on preferred sites on the furnace chamber wall, which measure the local radiation intensity and display it on the monitor.

Known devices and methods for cleaning heating surfaces normally employ the position of the water lance blower when tracking its blowing pattern, in order to effect a connection between the surface to be cleaned and the water jet. This connection is based on geometrical considerations, wherein it is assumed that the target point of the water lance blower on the surface to be cleaned which can be derived by geometry coincides with the site of impact of the water jet. It has been attempted, as disclosed for example in DD 281 468, to memorise and later to employ a blowing pattern by observing a water jet.

SUMMARY OF THE INVENTION

The object of the present invention is to provide methods which can be used for a specific, planned cleaning of a pre-determinable surface of an internal chamber when there are different conditions in the internal chamber. Furthermore, it is the object of the invention to provide a blower lance which makes an effective, planned cleaning of a pre-determinable surface of an internal chamber possible with different conditions in the internal chamber.

According to one aspect of the invention there is provided a method for positioning a controllable blower lance for cleaning a pre-determined surface of a heatable internal chamber, in which deposits form, said method comprising: impacting at least one site with a cleaning medium of the blower lance on a surface to be cleaned of the internal chamber; determining a direction of flow of the cleaning medium out of the blower lance; recording at least one position of at least a part of the blower lance; correlating the at least one site of said impacting and the at least one position of said recording, wherein said correlating comprises taking into account at least one internal chamber parameter, whereby a position of the blower lance can be determined for cleaning the pre-determined surface according to current conditions in the internal chamber.

According to a further aspect of the invention there is provided a method for cleaning a heatable internal chamber in which deposits form with a controllable blower lance, the method comprising: correlating a condition in the internal chamber and/or a condition of the cleaning medium; superimposing a pre-determined control system of the blower lance and a result of said correlating; and striking a pre-determined surface of the internal chamber to be cleaned with a cleaning medium, whereby the pre-determined surface to be cleaned is struck according to plan by the cleaning medium whatever the conditions in the internal chamber.

According to another aspect of the invention, there is provided a controllable blower lance for cleaning a heatable internal chamber, in which deposits form, with a cleaning medium which strikes a surface to be cleaned in the internal chamber, said blower lance comprising: a programmable control of the blower lance; and a storage which memorises at least one correlation for planned cleaning of the surface to be cleaned dependent upon the condition in the internal chamber.

The invention provides a method for determining positioning of a controllable blower lance for cleaning a pre-determinable surface of a heatable internal chamber, preferably of a combustion chamber, in which deposits form, wherein at least one site of impact of a cleaning medium of the blower lance on a surface to be cleaned of the internal chamber and at least one position of at least a part of the blower lance, by means of which the direction of flow of the cleaning medium out of the blower lance can be determined, are established and recorded and a correlation is established between at least the site of impact and the position, taking into account at least one parameter concerning the internal chamber, wherein by means of the correlation, the positioning of the blower lance can be determined for cleaning the pre-determinable surface according to the current conditions in the internal chamber.

Furthermore, the invention provides a method for cleaning a heatable internal chamber, preferably of a combustion chamber, in which deposits form, with a controllable blower lance, the cleaning medium of which has to strike a pre-determinable surface to be cleaned in the internal chamber, wherein a pre-determined control of the blower lance is superimposed onto a correlation associated with the condition of the internal chamber and/or the condition of the cleaning medium such that the pre-determinable surface to be cleaned is struck according to plan by the cleaning medium, whatever the conditions in the internal chamber.

In addition, a controllable blower lance is provided for cleaning a heatable internal chamber, in particular of a combustion chamber, in which deposits form, the cleaning medium of which strikes a surface to be cleaned in the internal chamber, wherein this is provided with programmable control of the blower lance and means for memorising at least one correlation, for planned cleaning of the surface to be cleaned in accordance with the conditions in the internal chamber.

The correlation for cleaning is preferably based on observation of at least one impact site of the cleaning medium on a surface of the internal chamber when there are certain conditions in the internal chamber, and at least one known position of at least one part of the blower lance, by means of which the direction of flow of the cleaning medium out of the blower lance can be determined.

In this advantageous manner it is possible to even out the almost uncontrollable different flows with eddies and extreme differences in speed and changes in flow direction occurring during the actual operation of a furnace, such that the cleaning medium actually, and thereby according to plan, carries out a cleaning pattern on the pre-determined surface to be cleaned. Simple equation of the jet geometry, of the lance direction and of the target point on the surface to be cleaned found thereby, particularly a wall surface, with the site of impact, does not reflect the real situation. Changes in speed of the flames and gas streams, which differ according to the construction and size of the boiler, are not only present on the walls and deflectors or occur depending on the amount of load or air, but instead the flow profile in the furnace alters with any basic change in the injection conditions of the burner system such as, for example, when there is a change in the milling or the change in the number of burners in operation, and also with a change of fuel. These flows, together with the gravity acting on the water jet and the fanning out of the jet along the blowing path, affect the impact site and the cleaning medium impact surface. Our own tests have shown divergences of several meters, and also ovalness of the impact surface in any direction. It is therefore advantageous that at least a part of the blower lance is positioned, and/or that a value, such as a pressure, a volume flow or a flow speed, characteristic of the cleaning medium, is controlled or regulated such that the pre-determinable surface to be cleaned is struck by the cleaning medium. In this way it is possible to undertake a necessary change corresponding to changes of a condition, for example, inside a boiler, so that cleaning patterns to be followed remain workable in a precise manner. In this way unnecessary and possibly damaging flowing of the cleaning medium onto the wall surfaces is avoided and a suitable selection of a blowing pattern and the frequency and intensity of the blowing operation can be made. Any surfaces to be cleaned, such as those of the walls of the internal chamber or of heat exchangers located in the internal chamber can consequently be treated differently as appropriate.

The determination of the site of impact can be done by suitable sensing means, whereby preferably sensors in the walls to be cleaned or optical devices can be used. An advantageous embodiment of a method according to the invention provides that one or more sensors are located in the walls to be cleaned. They are struck by the cleaning medium, and this is detected and transmitted by the sensors. In accordance with, for example, the operational state of the internal chamber to be cleaned, parameters such as the site of impact, the position of a part of the lance blower by means of which the direction of flowing out of the cleaning medium is determined, and a characteristic parameter, for example the loading condition of the boiler, can be recorded. A further configuration of the invention provides that determining of the site of impact is by means of a physical and/or chemical effect caused by the impacting cleaning medium. In particular, shock effects caused by the temperature difference of the cleaning medium and the surface to be cleaned of the internal chamber can be localised. Visual or optical observations such as photography, films or other light/laser/thermal radiation methods are also suitable for definitive association of the points on the wall where there are surfaces to be cleaned with points of impact of the cleaning medium. An advantageous further development provides that suitable means are present for determining vibration or oscillations caused by the impact of the cleaning medium on the surface to be cleaned, or that the impact of the cleaning medium is determined at a viewing hatch or at an opened hatch and the impact site is thereby located and recorded. Correspondingly, suitable sensors can also be advantageously fitted outside the surface to be cleaned. In furnaces they should not be exposed to the surrounding temperatures prevailing therein. A change in the local temperature because of the low temperature of the cleaning medium and of its site of impact compared to the surrounding temperature can also be determined by means of emission measurement thereof. In a further configuration the site of impact, its centre, its dimensions and the jet pressure is sensed when, for example, the point sensor is swept, and is used for correlation.

An advantage of the invention is that the method for determining positioning of a controllable blower lance and the method for cleaning the heatable internal chamber with a controllable blower lance do not absolutely have to be carried out together. In this way it is possible to undertake appropriate measurements of a known internal chamber to determine the positioning and to establish one or more correlations based on the measurements, so that the lance blower can be positioned. The correlations obtained for the internal chamber, for example of a furnace boiler, can then be used directly in a method for cleaning. However, it is also possible to transfer the correlations obtained to internal chambers of a similar construction. An appropriate method for cleaning this internal chamber can then be adapted according to the geometry or flow conditions present in the boiler or constructional geometry of the blower lance, by means of the correlations. It is advantageous to enter into a correlation a relationship made between the site of impact and the theoretical target point of the jet of cleaning medium on the surface to be cleaned of the internal chamber, obtainable from the geometry of the position of the cleaning device. In particular when there is a divergence between these two places it is advantageous to enter a correction value into a correlation. It is, for example, advantageous for adjusting the cleaning device to be able to make a change in the position of the blower lance from known divergences during tracking of the cleaning pattern. In order to determine suitable correlations it is advantageous to be able to estimate surfaces still to be cleaned with local hypothetical impact sites from known impact sites and positions of the blower lance as reference values. In addition it is particularly advantageous to undertake the calculation of the hypothetical site of impact from at least three values each of the impact site and position of the blower lance in the form of linked vector fields. As the geometry of the internal chamber is known, in a further development of the method a mathematical model, which preferably also characterises the condition of the internal chamber, can be obtained for controlling the site of impact. If the internal chamber is operated under defined conditions, corresponding parameters can be determined and recorded, with simultaneous determination of a site of impact and an associated position of the blower lance. This is also the case for a condition of the cleaning medium to be registered, which can also be established by means of a mathematical model. In this manner cleaning patterns can be made which can be extremely accurately tracked according to the thickness of the impact site determined. It is advantageous not only for the mathematical modelling but also, for example, for the determination or control of the impact site, to treat it as an impact point. The lack of edge definition of a site can then be determined if required. For areas at risk such as, for example, furnace apertures in a burner area, an impact site is determined such that damage due to the cleaning medium during performance of a blowing pattern of the blower lance is excluded. In order to prevent the risk of a difference between the positioning and the corresponding correlation because of mechanical clearance or thermal expansions on the suspension of the water lance blower, in a further development of the invention it is ascertained whether a correlation of the impact site with a pre-determined planned surface to be cleaned by the cleaning medium is sufficiently in agreement. If there is too large a divergence, a correction of the correlation and the positioning is undertaken. An advantageous configuration of the invention provides that the blower lance is driven by means of a suitable trial mode of the control system such that defined impact sites are found and recorded for positioning.

The at least one parameter which is concerned with the internal chamber, which concerns a condition in the internal chamber, provides the possibility of allowing the conditions prevailing there to have an influence upon the correlation. The taking into account of the condition of the cleaning medium in turn allows the pre-determinable surface to be cleaned to be struck according to plan, for example, by means of mass build-up regulation of an attached pump, which is the cause of the build up of pressure of the cleaning medium. For this, a configuration of the blower lance according to the invention is provided with suitable means for sensing the parameter or parameters. Because, as explained above, the flow profile is different over a cross-section of the internal chamber during different operating conditions, in particular parameters such as pressure, speed, temperature and mass flow, the possible different composition thereof, and, for example, fuel quality and different air conditions, material characteristics such as the condition of an internal chamber or a chemical variable such as, for example, an acid value, are employed. It is further advantageous to also allow an operating condition of at least a part of a connected installation, as a parameter which concerns a condition in the internal chamber, to influence the correlation. In the case of boiler installations, a condition in the internal chamber can be determined, for example, concerning the load being operated or the type of mill connected. Consideration of the ageing condition of the surfaces to be cleaned compared to a previously established reference condition is an important parameter which can be taken into account for the correlation. According to the invention the cleaning medium itself is also taken into account for precise tracking of a cleaning pattern on the surface to be cleaned. Parameters such as the delivery pressure, the volume flow or the delivery speed from the blower lance are important for calculation and establishment of the impact site. In particular these parameters can also be controlled and even regulated by means of suitable devices, wherein for example an appropriate control circuit which regulates the correlation for positioning the blower lance is also used. The composition of the cleaning medium can also be correspondingly adapted to the surfaces to be cleaned by using suitable agents. The blower lance itself also has an influence on the blowing pattern to be carried out and the cleaning pattern on the surface to be cleaned, because of its constructional geometry. In addition to the location of the attachment of the blower lance, the dimensioning of the nozzle thereof plays a significant role in how the cleaning material ejected behaves in the internal chamber to be cleaned. In a further development, the geometry of the nozzle is adjustable according to the pre-determinable surface to be cleaned. This can be by exchanging the nozzle or by means of suitable attachments.

An advantageous configuration of the invention provides that a planned cleaning pattern is pre-determined and by means of a suitable correlation the cleaning medium performs this on the surface to be cleaned in the internal chamber.

It is advantageous for prediction, with respect to the condition of the surface to be cleaned and of the success of the cleaning, that recording of the impact site and of at least one parameter of the correlation over the cleaning time, over a longer time period or only for a point in time, should be undertaken. In this way it can be established whether the cleaning was successful or whether it needs to be carried out again. Furthermore, it can be established from this data whether operation should be with the same or with other values, for example, of the cleaning medium, such as pressure or mass flow so that effective but non-damaging cleaning can be undertaken. A further development provides that recorded measurements can be evaluated such that future advantageous cleaning patterns can be determined. This can also include the time of a cleaning which is due. According to the operating conditions, for example, of a boiler, cleaning can in the meantime involve considerable power losses in the boiler. This is evident from an obvious reduction in the degree of efficiency in low load operated boilers.

BRIEF DESCRIPTION OF THE DRAWINGS

Further advantages and characteristics of the invention will be explained in more detail with reference to a preferred embodiment and the following drawings. Advantageous further developments will also be evident from the features disclosed.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Figure 1:
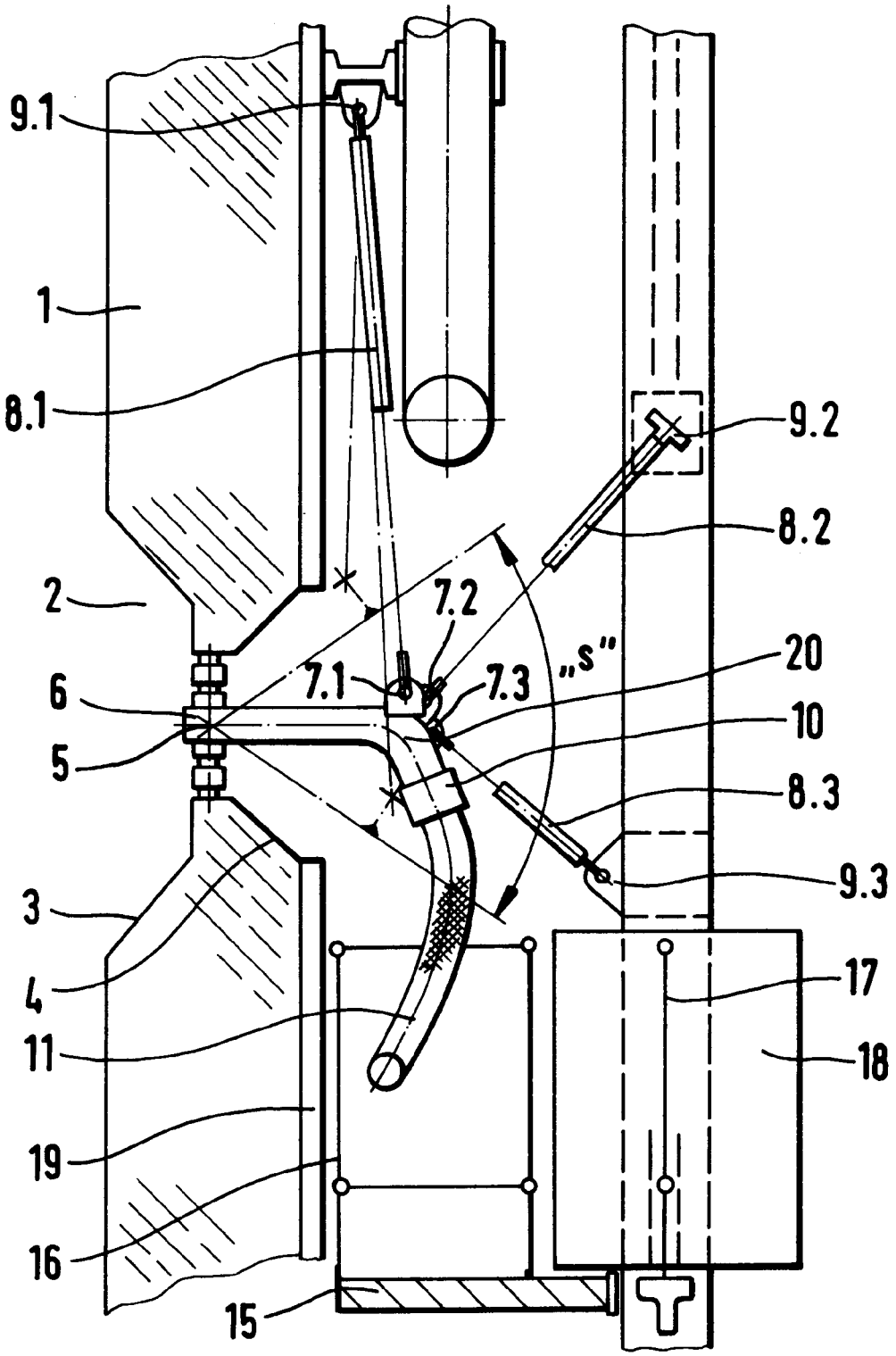
FIG. 1 is a side view of a controllable water lance blower.

FIG. 1 is for clarity, and shows a side view of a controllable water lance blower. In the wall 1 of a heating installation there is located a hatch 2 with angled pieces towards the inside 3 and the outside 4. In the hatch 2 there is located the movement point 5 of the water lance 6 in the form of a swivel bearing or ball joint for the water lance 6 attached in a fixed manner to its centre. The water lance 6 is provided at the rear end with fixing points 7.1, 7.2, 7.3 in which the lance-side ends of the movement elements 8.1, 8.2, 8.3 are rotatably mounted but not moveable on the lance. The rearward ends of the movement elements 8.1, 8.2, 8.3 are rotatably integrated into the locating bearings 9.1, 9.2, 9.3, for example ball joints. The entry of water into the lance 6 is via a connector 10 and a water supply 11 as a water path 20, in the form of a pressure resistant flexible hose. The heating installation is surrounded by numerous components which sometimes impede assembly. For example, above the hatch 2 a steam pipe to 13 and the locating bearing 9.1 are fixed on a first support 12. A second support 14 is arranged at a short distance away to the right adjacent to the hatch 2. To the right of this a grating floor, serving as a working platform, terminates. The second support 14 also delimits the rails 16 and 17 and the footway and working platform 15 and supports a switchgear cupboard 18. The distance between the steam pipe 13 and the outer skin 19 of the wall 1 is very restricted.

The end of the lance can be pivoted by means of its movement elements 8.1, 8.2, 8.3 in the slewing range S vertically from above "o" to below "u" and in its horizontal range from left "l" to right "r".

Where there are pre-determined controlled distances apart between the points 9.1–7.1 and 9.3–7.3, every position of the lance is clearly fixed, together with the front swivel bearing of the lance.

In FIG. 1, on the movement elements 8.1 to 8.3, there are located control elements, which are not shown, which set the lengths of the movement elements according to the pre-determined blowing pattern and the measured values of the path sensors 44 shown of the position of the water lance. In all the working positions of the lance, each movement element 8.1–8.3 carries out a change in length and speed of change in length dependent upon the spatial geometry of the distances, angular arrangements and the geometric location of the mountings 7.1–7.3 and locating bearings 9.1–9.3, which mutually effect the movement of the lance and the guiding of the water jet. In addition on one side of the support 14 there are means 45 for registering and for controlling the movement of the movement elements. The site of the attachment of the control means is, however, not confined to the direct proximity of the water lance blower. By means of suitable data transfer paths 46 connected to the lance blower, the control means can also be installed in a control room in order that they can be quickly referred back to.

In an embodiment according to the invention, after mounting of the water lance blower, the geometry between the movement point 5, the fixing points on the water lance 7.1–7.3 and locating bearings 9.1–9.3 is measured, the results input into a computer program and the change in each movement element memorised there according to the blowing location and/or the blowing time for pre-determined blowing patterns, and during operation is transferred via the control elements to the movement elements.

In a further embodiment, during the setting-up phase for the working areas, the distances of the movement elements beyond the primary movement of the lance or a stop, which is not shown, on the end of the lance, which is mechanically coupled to a device for setting the blowing path, can be set. The changes in length of the individual movement elements resulting from each movement of the setting-up device and stop are registered and memorised by the path sensors. Any blowing patterns can therefore be pre-determined using the setting-up device. After removal of the setting-up device and the initialising of the control and water blowing, the movements memorised are started.

Figure 3:
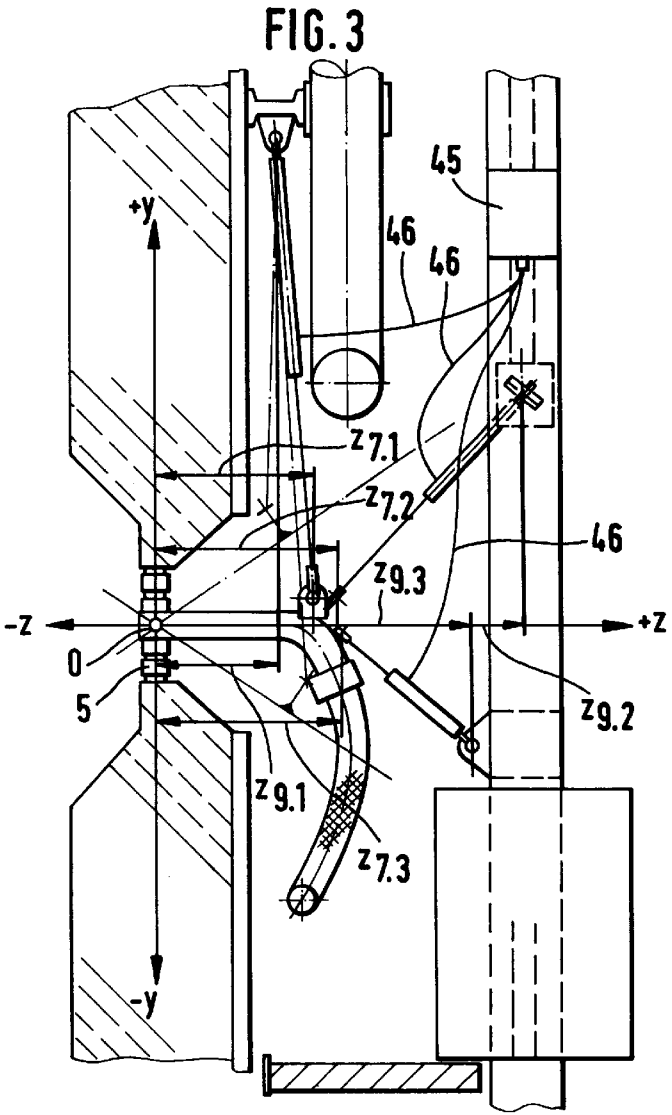
FIG. 3 is a view of the water lance blower from FIG. 1 with a corresponding coordinate system.
Figure 2:
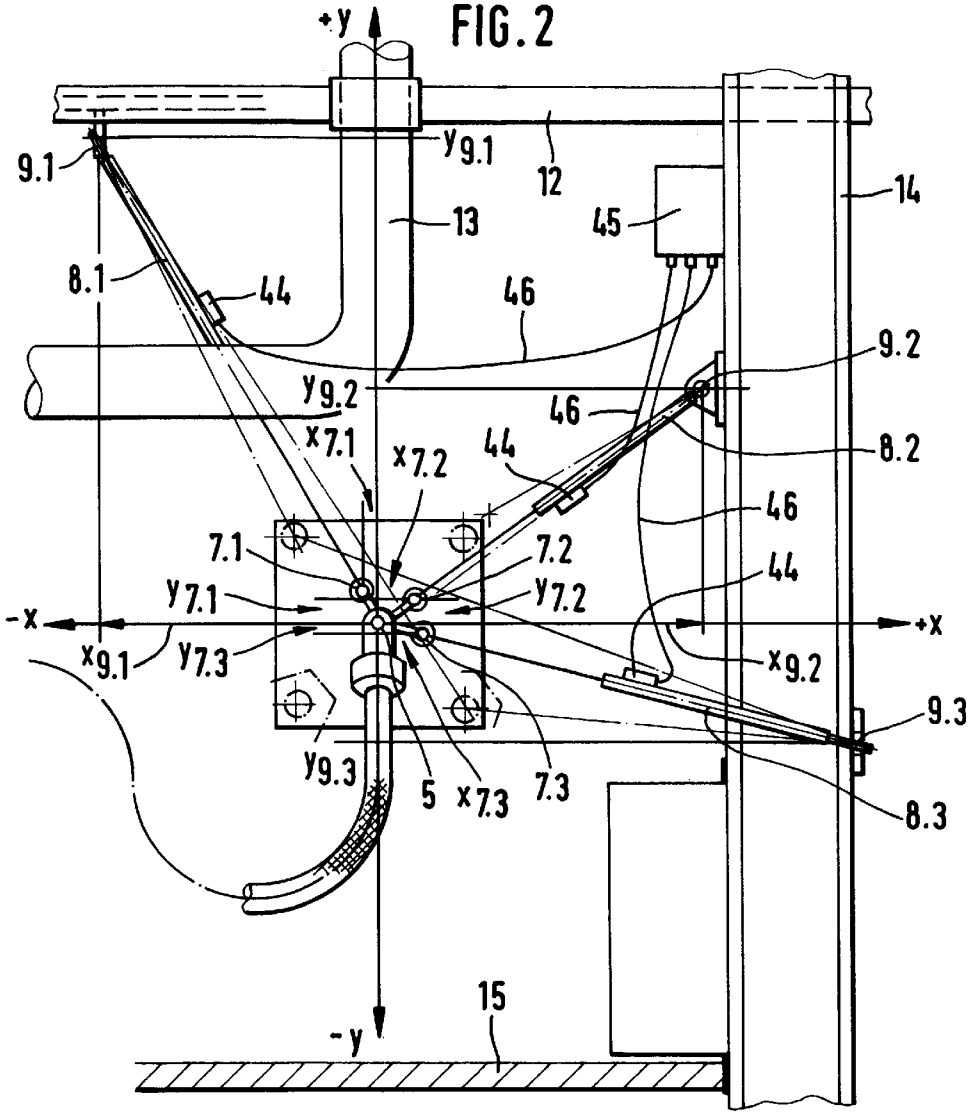
FIG. 2 is a further side view of the controllable water lance blower from FIG. 1.

In FIGS. 2 and 3, the solution according to the invention will hereinafter be described in detail with reference to an example:

The water lance blower according to FIG. 1 should, after assembly, when the lance is in a centred position, have axially at the point of movement 5 the following geometrical dimensions for the setting-up of the movement elements 8.1–8.3, its locating bearings 9.1–9.3 and points of fixation 7.1–7.3 on the water lance 6 with respect to the central point of rotation of the pivoting device 5, which is determined as the geometric point 0 (FIGS. 4 and 5):

| Rotation point of part no. | Geometric point X | Y | Z |
|---|---|---|---|
| 5 | 0 | 0 | 0 |
| 7.1 | $X_{7.1}$ | $Y_{7.1}$ | $Z_{7.1}$ |
| 7.2 | $X_{7.2}$ | $Y_{7.2}$ | $Z_{7.2}$ |
| 7.3 | $X_{7.3}$ | $Y_{7.3}$ | $Z_{7.3}$ |
| 9.1 | $X_{9.1}$ | $Y_{9.1}$ | $Z_{9.1}$ |
| 9.2 | $X_{9.2}$ | $Y_{9.2}$ | $Z_{9.2}$ |
| 9.3 | $X_{9.3}$ | $Y_{9.3}$ | $Z_{9.3}$ |

Naturally, the coordinates shown in FIGS. 2 and 3 and the above table only apply to point rotational points, for example in the form of a ball joint. In the simplified solution shown in FIGS. 1, 2 and 3 with eye and annular shaped connecting elements, possible corrections may still have to be made for the point of rotation. These are decided by testing, however, as there is a necessary range of tolerance with all mechanical movements of the movement elements.

The geometric, theoretical coordinates of the wall area to be cleaned and the limits thereof are determined by means of the point of rotation with the coordinates X; Y; Z=0, such that the geometrically straight line of the theoretical jet of water of the lance 6 on the wall surfaces of the heating installation determines a geometrical point 12 on the wall for each allocated lance position. These coordinates can be employed within the framework of the invention for determination of correction values of the water lance position.

Figure 4:
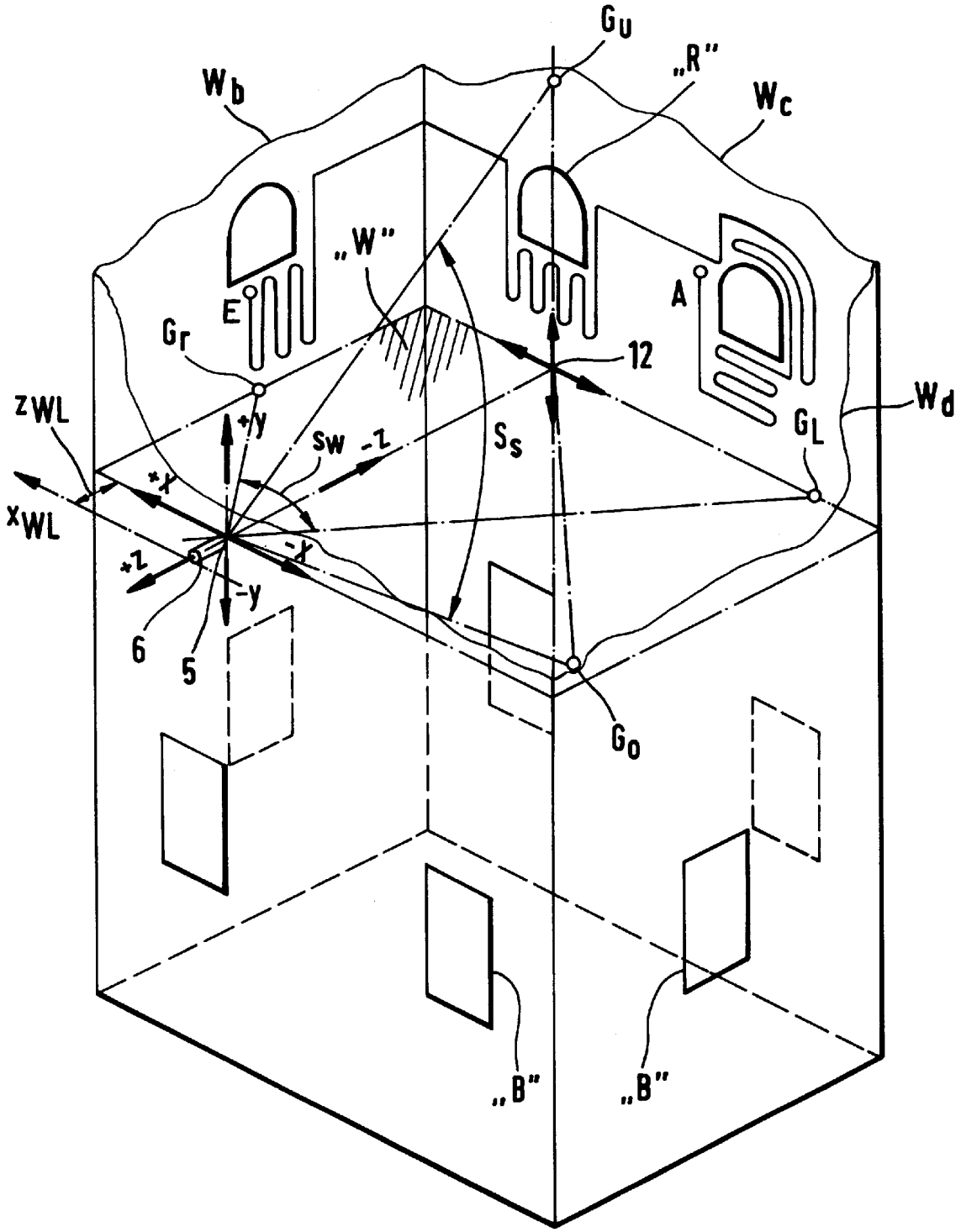
FIG. 4 is a view of the geometry of a heatable internal chamber in the configuration of a part of a combustion chamber.

FIG. 4 shows the geometry of a part of a combustion chamber. In the lower part there are located six furnace apertures B, in the upper part six waste gas recirculations R. The state of assembly of a water lance 6 according to FIGS. 2, 3 is shown with its point of movement 5. For the horizontal plane "W" with the coordinates Y=0, there is the blowing limit $G_r$ on the combustion chamber wall $W_b$, above the horizontal slewing range $S_w$, on the combustion chamber wall $W_c$, the blowing limit $G_1$, for the plane X=0 there is the blowing limit $G_0$ on the combustion chamber wall $W_c$, above the perpendicular slewing range $S_s$ the limit point $G_u$, (above, right and so forth is logically arranged in mirror image to FIGS. 2, 3). Any further point on the wall of the combustion chamber can be geometrically allocated a coordinate of the lance position. In a preferred embodiment, this is done geometrically by employing the combustion chamber dimensions available, for example, using a mathematical program.

In an alternative embodiment characteristic points of the combustion chamber wall are determined by means of local measurement, for example by means of laser beams replacing the lance provided which are used when the boiler is at a standstill, though naturally, with this the length and crosswise expansion of the wall surfaces during operation of the boiler must be taken into account, or other suitable measuring devices during constant operation.

In an analogous manner blowing paths for the surface areas to be cleaned are determined geometrically by mathematical or measuring techniques and are input into the control system for the movement elements 8.1–8.3. An example of this is the blowing pattern shown in FIG. 4 for cleaning the slag formations below some waste gas recirculators R and above a waste gas recirculator. The cleaning program begins at A and ends at E. The theoretical mode of working is such that after programming of the allocated theoretical path-time diagrams, for example in the computer or unit controller data store, and after input of the corresponding cleaning command the water lance blower travels into the theoretical position A (FIG. 4) and with opening of the water supply the path-time program of the movement elements 8.1–8.3 is carried out as far as point E and there the water supply shuts off again.

The previously described programming and controlling of the blowing pattern as the so-called theoretical blowing pattern with a theoretical geometrically straight water jet is subject in this embodiment to the correction, now following, of the control system dependent on a parameter concerning the internal chamber, for example the operating condition of the interior of the combustion chamber.

Figure 5:
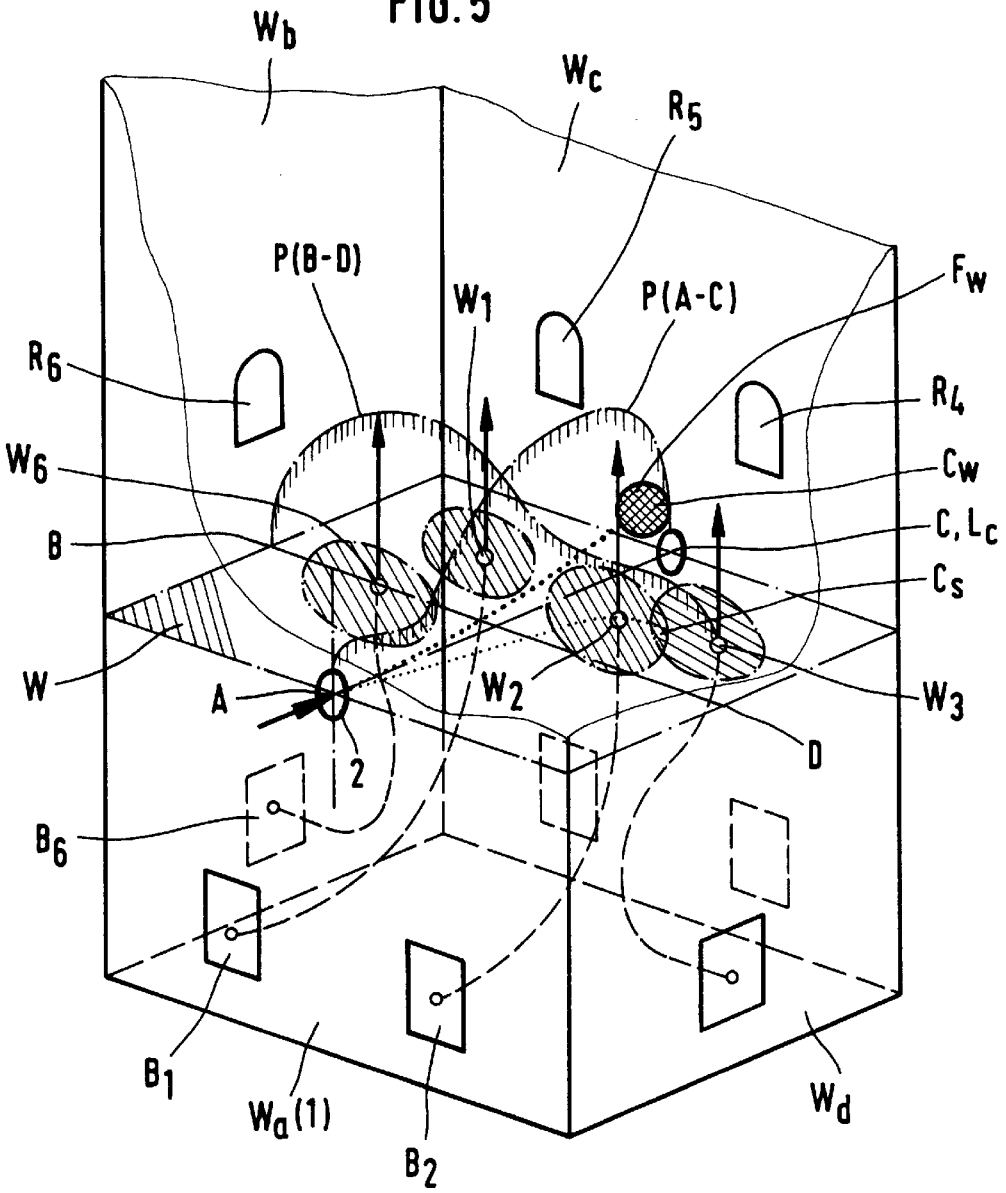
FIG. 5 is a diagram of a correction method for a control system on the part of the combustion chamber from FIG. 4.

In the example according to FIG. 5, the basic principle of a correction method for the control system is described. A combustion chamber is delimited by the walls $W_{a(l)}$, $W_b$, $W_c$ and $W_d$ to be cleaned. In the lower part of the walls there are located the furnace apertures $B_1$ to $B_6$, in the upper part the waste gas recirculations $R_1$ to $R_6$. In the wall $W_a$ the hatch $L_a$ is arranged centrally, in the wall $W_c$, the hatch $L_c$. In the centre of the hatches are located respectively the geometric points A and C thereof. A horizontal geometric plane E is arranged through the points A and C, which meets the walls $W_b$ and $W_d$ centrally at the geometric points B and D.

During an operating condition $Z_1$ of the combustion chamber, the burners $B_1$, $B_2$, $B_3$ and $B_6$ are in operation, as shown in FIG. 5. Because of the load level L operated in the boiler, for example, $L_1$=90% and an air ratio=lambda in an operating condition $Z_1$, a predetermined amount of gas (mill conveying gas and hot air) is blown into the combustion chamber. Depending on the load, amount/quality of fuel, air ratio and in particular the mill/burner combination in operation in the operating condition $Z_1$, a flow profile is produced in the combustion chamber which generally differs from other operating conditions. In order to illustrate this operating condition $Z_1$, the speed profile P (A–C) and P (B–D) of the flame/smoke mixture at the level of the plane W along the lines A–C and B–D is shown by dot and dash lines in the perpendicular plane, and the speed centres $W_1$, $W_2$, $W_3$ and $W_6$ of the allocated flame streams shown by a broken line as they pass through the plane W. The speed profile shows a concentration of the flame flow in the area of the C and B wall-side cross-sections, with a significant increase in speed compared to the wall areas A and D.

The water lance 6 is installed in the hatch 2. As an example the geometric point C on the wall $W_c$ is obtained with the perpendicular position shown of this lance 6 with respect to the wall $W_a$ (lance coordinate F (0,0)) corresponding to the line A–C. Because of the effect of gravity of the jet, in practice in the case of a boiler not in service, a parabolic jet path would exist, which meets the wall $W_c$ at the site $C_s$ shown as a thin, dotted line. The upwards flow together with the flow speeds strongly increasing in the direction of the corner $W_b/W_c$ of the combustion chamber, as described above, leads, in the operating condition $Z_1$, with the lance position 1 (0,0), to guidance of the stream according to the thick dotted line and to the "true point of impact" $C_w$. With this, the "true" surface $F_w$ struck has an ovalness dependent upon the flow. The effect of this divergence of the impact point $F_w$ of the water jet from the geometric jet coordinates of the point C (0,0) of the lance position L (0,0) on the blowing pattern is recognised according to the invention and not negated.

In the configuration according to the invention shown here, of a method for determining a positioning of a controllable blower lance, when there is a model operation $Z_1$, the lance is moved from the initial position L (0,0) such that the true impact point $C_w$ of the jet is reliably determined and is therefore also struck "truly". This is done, for example, in that with an opened hatch $L_c$, the position L ($x_0$, $y_0$) of the lance is determined in which the water jet striking the wall $W_c$ clearly blows through the opened hatch in the boiler housing. Now, the "true" impact surface of the point C on the wall $W_c$ with the theoretical guide coordinate F (0,0), now definitely determined, is allocated in the control system of the blower with the "true" lance position L ($X_0$, $y_0$).

Figure 6:
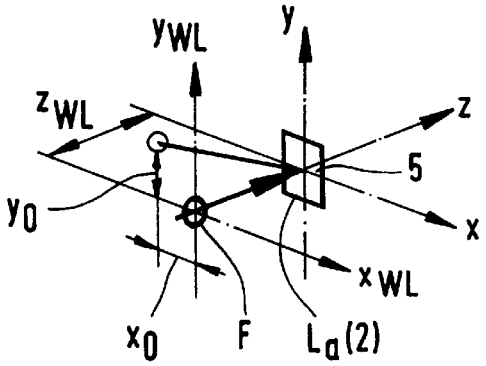
FIG. 6 is a view of a record, according to coordinates, of the water lance position in FIG. 5.

FIG. 6 shows a record, according to coordinates, of the water lance position from FIG. 5. To transform the positions of the movement elements 8.1–8.3 and of their fixing points 7.1–7.3 from FIGS. 1–3 into coordinates for the lance position, in accordance with FIGS. 4 and 5, a guide plane F is spanned at a distance $Z_{WL}$ from the point of rotation 5 (Z=0). The lance axis passes through this plane F at the coordinate point $Y_{WL}$, $X_{WL}$. Consequently a coordinate F (Y, X) is allocated with the length and coordinates of the movement elements 8.1–8.3 of every lance position. As in the example from FIG. 5 this plane F is at an angle of 90° to the combustion chamber walls $W_b$, $W_d$ and at 0° to the combustion chamber wall $W_c$, simplified mathematical relationships are produced of the geometry between the direction of the lance jet F (Y; X) and the theoretical impact point of the jet on the walls described above. When there is a known true impact point $C_w$ in a known operating condition $Z_1$, a corresponding assignment of coordinates is implemented.

Figure 7:
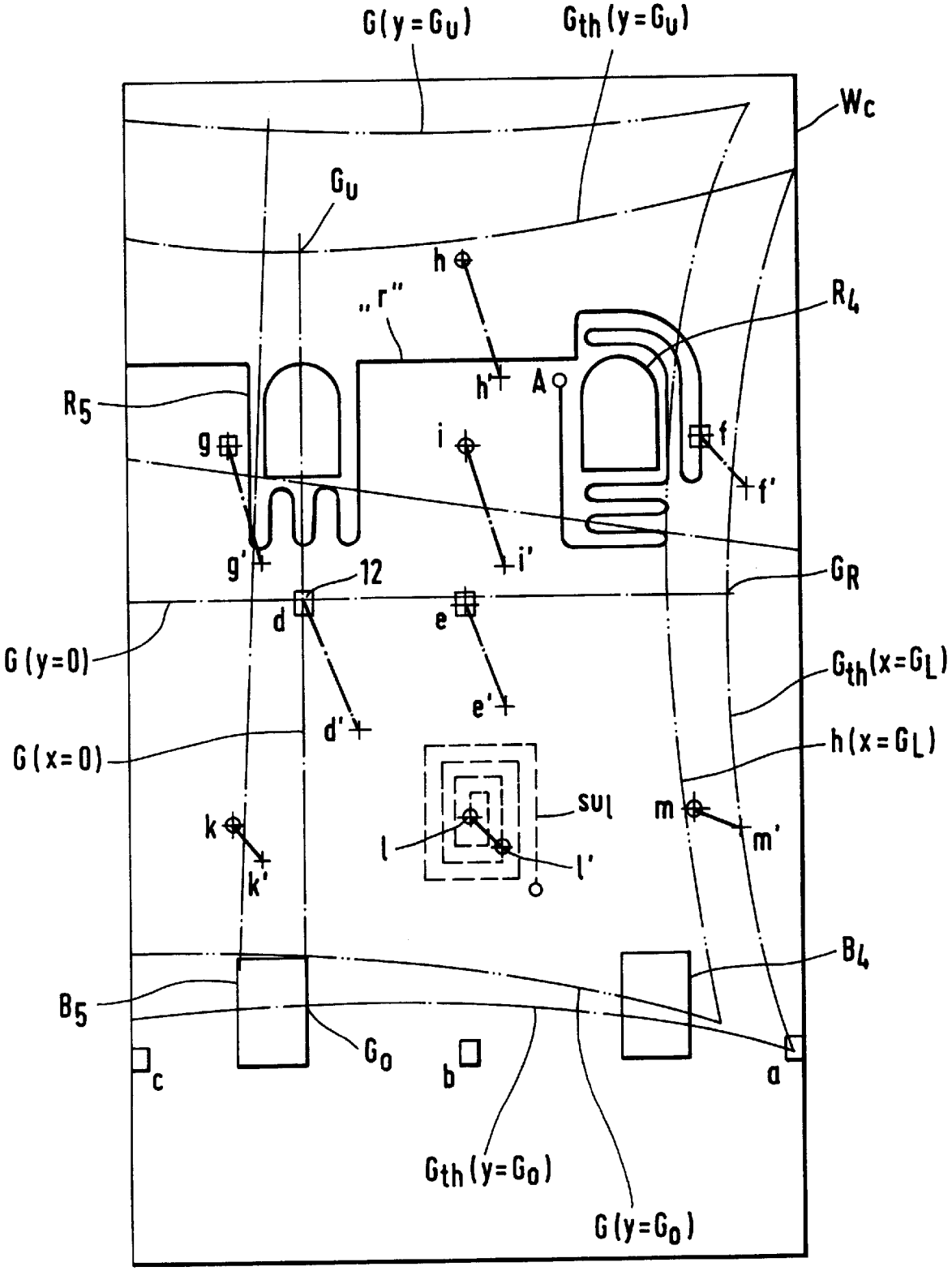
FIG. 7 is a view of a mode of operation of a correction method.

FIG. 7 shows the effect of a method of correction from the theoretical to the "true" impact area of the water lance blower explained for the example described. The combustion chamber from FIGS. 4, 5 has the combustion chamber wall $W_c$ which is shown in FIG. 7. The wall $W_c$ also has the large hatches a to g and the small hatches i to m, and further the gas recirculators $R_4$ and $R_5$, and the furnace apertures $B_4$ and $B_5$. The theoretical blowing pattern A–E shown in FIG. 4, for cleaning the environment of the smoke recirculators $R_{4,5,6}$ is also shown in FIG. 7 with its part of the pattern "r" beginning from A on the wall $W_c$. On the wall $W_c$ there are shown

- the theoretical horizontal blowing lines $G_{th}$ (y=0) of the slewing range $S_w$ from the left-hand combustion chamber corner to $G_1$, explained in FIG. 4,
- the theoretical perpendicular blowing line $G_{th}$ (x=0) of the stewing range $S_s$ from $G_o$ to $G_u$,
- the theoretical horizontal blowing line $G_{th}$ (y=$G_u$) from the angle 12-5-$G_u$ over the slewing range $S_w$,
- the theoretical horizontal blowing line $G_{th}$ (y=$G_o$) from the angle 12-5-$G_o$ over the slewing range $S_w$,
- the theoretical perpendicular blowing line $G_{th}$ (x=$G_l$) from the angle 12-5-$G_l$ over the slewing range $S_s$, The last three are, in this embodiment, delimiting lines of the slewing range and because of the geometric arrangements from parabolic lines when the control of the water lance blower is by means of the coordinate planes F and y=constant and x=constant except when x=0 and y=0. Because of the flow and gravity effects of the known and registered operating condition $Z_1$, with the limits of the blowing patterns described, the blowing field $G_{th}$ is moved even further by the deflection of the blown jet so that the blowing limits B are "truly" obtained on the wall $W_c$. In this way during operation corrections of x and y are necessary when tracking theoretical horizontal/perpendicular blowing lines on the wall $W_c$. These corrections become greater when the blown jet sweeps the walls set at 90°, in this case $W_b$.

The correction of the "true" blowing surface F on the wall $W_c$ in the direction of theoretical delimitations $G_{th}$ (y=$G_u$), $G_{th}$ (x=$G_l$), $G_{th}$ (y=$G_o$) with the left-hand corner delimitation of $W_b/W_c$ is done as follows:

0. The theoretical limit coordinates $G_{th}$ are calculated, by means of a mathematical program, for the wall $W_c$ and assigned to a control program $F_p$ for the coordinate plane F of the water lance blower. In an analogous manner, the field delimited by the $G_{th}$ lines is calculated and assigned individual coordinates in a surface covering manner.
1. The water lance blower control system receives a trial program in which the environment of a trial coordinate is tracked in a stepwise manner. A theoretical blowing pattern "$su_1$ " of the trial program is shown representative of all trial coordinates for the trial coordinate 1 of the hatch 1.
2. The theoretical coordinate 1 ($x_1$, $y_1$) of the water lance blower on the guide plane F (FIGS. 4, 5) for the theoretical impact point 1 is input into the trial program. The hatch 1 is opened. The blowing program $su_1$ is started. The water jet blows the trial program $su_1$ in a stepwise manner, beginning at the theoretical coordinate 1. If the blowing pattern reaches a coordinate at which the water jet clearly and maximally blows through the hatch, the program is stopped and the coordinate of the water lance blower on the guide plane F is registered and these "true" impact coordinates 1' ($x_1'$, $y_1'$) are memorised under 1'. For the example in FIG. 7, this is done on the wall $W_c$ at the location of the theoretical coordinate 1'. The time of stopping $t_{F,1}$ of the program $su_1$ on the guide plane F an the time of impact $t_{Wc,1}$ on the wall $W_c$ then do not correspond at the location 1. The running time t of the jet from leaving the nozzle until impact at 1 must be taken into account. It is determined experimentally or mathematically dependent on the conditions of the jet delivery (pressure, diameter, amount and so forth).
3. In the same way as in 2. this method is carried out for selected or all hatches a to m and the "true" coordinates a' to m' are memorised. In the example, the coordinates of the hatches a–c are not affected and are omitted from the further correction.
4. By means of a mathematical program, the corrections d–d' to m–m' are input into the surface program $F_p$ of the water lance blower coordinate plane F and this is converted by means, for example, of vector correction, into the true impact surface program $F_p'$ ($Z_1$).
5. After 4. all the coordinates on the wall $W_c$ are assigned a "true" lance position by means of the program $F_p'$ such that for the operating condition $Z_1$ every wall coordinate is struck exactly using the true water lance coordinates, and the theoretical blowing limits $G_{th}$ are also actually obtained as "true" limits.
6. For the blowing operation certain blowing patterns are pre-determined on the wall. In the example, this is the blowing figure from A–E of FIG. 4. Its theoretical blowing coordinates are memorised in the program $F_p$ as a sub-routine which adopts the geometric coordinate conversions in order to convert coordinates of the movement elements 8.1–8.3 into coordinates of the control plane and geometric coordinates of the impact point of a straight water jet on the wall surface.

The program $F_p'$ ($Z_1$) is activated by the program $F_p'$ by input of operating condition parameters, for example $Z_1$, and the theoretical coordinates of the blowing pattern A–E are converted into "true" coordinates A–E.

7. Given the command $F_p'$ $(Z_1)_{A-E}$ the blowing pattern A–E is tracked with operation of the water lance blower. In this case agreement between the theoretical or desired and the true blowing pattern A–E is obtained.

8. The correction method from points 2. to 6. is implemented and memorised for the most important operating conditions or any condition $Z_i$, and thereby the true blowing patterns can be travelled for different operating conditions $Z_i$.

9.1 If operating conditions $Z_K$ are not memorised, comparison of similarity with known operating conditions $Z_i$ can be implemented by means of program $P_A'$ and input of the operating condition $Z_K$, and thereby the most suitable conditions are assigned, with $Z_K=f(Z_i)$, and afterwards blowing patterns tracked.

9.2 The correction method from 2. to 6. can also be implemented after selection of $Z_K f(Z_i)$. This is done in a very brief manner because of the already approximated coordinates of a to m and afterwards $Z_K=Z_{i,new}$ programmed.

9.3 For a further operating circumstance with unknown internal conditions of the combustion chamber, only the blowing pattern is tracked with the program $F_p$, thereby there is at least one correction of the blowing pattern with respect to the slope of the walls and the angle arrangements. In the example of application, after this correction the pattern limits $G_{th}$ again have the wall coordinates x=constant and y=constant.

In a further example, the true impact sites a to m are determined by any common, but also by different, sensors or indicators on a combustion chamber or combustion chamber wall according to the method 1. to 3. Such techniques have already been described in detail hereinabove.

In a further method when the water lance blower method is initiated, in a first approximation only theoretical blowing patterns are tracked according to the program $F_p$, the registered sensor or indicator impact points are registered, the condition $Z_i$ assigned and in a second approximation when the same blowing pattern is repeated or other blowing patterns and the program $F_p$ $(Z_i)$ allocated in a second approximation. In this way by superimposing several approximations, and thereby measurements, maximum precision of blowing of the patterns, and also a permanent correction of true blowing coordinates, is obtained.

While the particular embodiments for methods for determining positioning of a controllable blower lance for cleaning a pre-determined surface of a heatable internal chamber as herein shown and disclosed in detail are fully capable of obtaining the objects and advantages herein before stated, it is to be understood that they are merely illustrative of the presently preferred embodiments of the invention and that no limitations are intended by the details of construction or design herein shown other than as described in the appended claims.

| List of designations | |
|---|---|
| 1 | wall |
| 2 | hatch |
| 3 | inside angled piece |
| 4 | outside angled piece |
| 5 | movement point, ball joint |
| 6 | water lance |
| 7.1–7.3 | fixing points on the water lance |
| 8.1–8.3 | movement elements |
| 9.1–9.3 | fixing points on the heating installation |

-continued

| List of designations | |
|---|---|
| 10 | water connection |
| 11 | water supply |
| 12 | first support |
| 13 | steam pipe |
| 14 | second support |
| 15 | grating floor |
| 16,17 | rails |
| 18 | switchgear cupboard, control cupboard |
| 19 | outer skin of the heating installation |
| 20 | water path |
| 44 | path sensor |
| 45 | means for controlling and/or registering |
| 46 | data transfer path |
| ΔAlpha | change in angle of rotation |
| ΔL | change in path |
| τ | time taken by the jet from the nozzle to the surface |
| A | beginning |
| A,B,C,D | central point in a hatch |
| B,B1–B6 | furnace aperture |
| $C_S$ | impact point of the water jet with a parabolic jet path |
| $C_W$ | true point of impact |
| E | end |
| FP | control program |
| $F_0$ | coordinate |
| $F_W$ | water jet impact area |
| G | limit point |
| $G_{l,r,o,u}$ | blowing limits |
| $G_{th}$ | theoretical blowing line |
| $L_{a,c}$ | hatch |
| L | load level of the boiler, lance position |
| $P_0$ | speed profile |
| R,R1–R6 | smoke recirculation aperture |
| S | working area |
| $S_s$ | perpendicular slewing range |
| $S_w$ | horizontal slewing range |
| W | plane |
| $W_{a,b,c,d}$ | combustion chamber wall |
| $W_1$ | water lance |
| $W_{1,2,3,6}$ | speed centre |
| X,Y,Z | coordinates |
| $Z_i$ | memorised operating condition |
| $Z_k$ | non-memorised operating condition |
| $Z_l$ | operating condition |
| a–m | hatch coordinates |
| l | left, theoretical impact point |
| l' | true impact point |
| o | top |
| r | right |
| su1 | theoretical blowing pattern |
| u | bottom |

What is claimed is:

1. A method for positioning a controllable blower lance for cleaning a pre-determined surface of a heatable internal chamber, in which deposits form, said method comprising:

impacting at least one site with a cleaning medium of the blower lance on a surface to be cleaned of the internal chamber;

determining a direction of flow of the cleaning medium out of the blower lance;

recording at least one position of at least a part of the blower lance;

correlating the at least one site of said impacting and the at least one position of said recording, wherein said correlating comprises taking into account at least one internal chamber parameter, whereby a position of the blower lance can be determined for cleaning the pre-determined surface according to conditions in the internal chamber during said impacting at least one site.

2. A method according to claim 1, wherein said recording comprises recording the at least one site and wherein said correlating the at least one site and the at least one position of said recording is done over time or a time period, said method further comprising predicting the success of cleaning and/or a condition of the surface cleaned or to be cleaned using memorised values.

3. A method according to claim 1, further comprising identifying necessary cleaning procedures for a subsequent cleaning and determining a time for a subsequent cleaning, with the aid of values which result from a cleaning procedure carried out.

4. A method according to claim 1, further comprising determining a cleaning medium parameter at the at least one site of said impacting, wherein the cleaning medium parameter is selected from a presence, a dimension, and a spatial distribution of the cleaning medium.

5. A method for cleaning a heatable internal chamber, in which deposits form, with a controllable blower lance, the method comprising:

correlating a condition in the internal chamber;

superimposing a pre-determined control system of the blower lance and a result of said correlating; and striking a pre-determined surface of the internal chamber to be cleaned with a cleaning medium, whereby the pre-determined surface to be cleaned is struck according to plan by the cleaning medium whatever the condition in the internal chamber of said correlating.

6. A method according to claim 5, wherein said correlating is based on an observation of at least one impact site of the cleaning medium on a surface of the internal chamber with certain conditions in the internal chamber, and at least one known position of at least a part of the blower lance, wherein said method further comprises determining a direction of flow of the cleaning medium out of the blower lance.

7. A method according to claim 5, further comprising positioning at least a part of the blower lance, and controlling a pressure, a volume flow or a flow speed which characterises the cleaning medium, whereby the predetermined surface to be cleaned is struck according to plan by the cleaning medium.

8. A method according to claim 5, further comprising pre-determining an impact site by a detecting means.

9. A method according to claim 8, wherein said heatable internal chamber has walls and wherein said detecting means comprise sensors in the walls to be cleaned.

10. A method according to claim 8, wherein said predetermining an impact site comprises impacting with a cleaning medium to cause a physical and/or chemical effect on a surface of the internal chamber.

11. A method according to claim 8, wherein said heatable internal chamber has walls and wherein said detecting means comprise optical means.

12. A method according to claim 5, wherein said correlating comprises obtaining from a geometry of the position of the blower lance a relationship between an impact site and a theoretical target point of the cleaning medium on a surface to be cleaned in the internal chamber, wherein said correlating comprises entering a correction value representing a divergence between the target point and the impact site of the cleaning medium.

13. A method according to claim 5, wherein said correlating comprises determining hypothetical impact sites from reference values which represent known impact sites and positions in a form of linked vector fields.

14. A method according to claim 5, wherein said correlating comprises entering a mathematical model of the internal chamber, for determination of a hypothetical impact site, wherein the model accounts for several parameters which characterise the condition of the internal chamber.

15. A method according to claim 5, further comprising obtaining an impact site and an associated position of the blower lance during operation of the internal chamber, and further comprising obtaining, at the same time, a parameter which characterises the condition of the internal chamber.

16. A method according to claim 5, further comprising determining an impact site in an immediate proximity of an area at risk from the cleaning medium, such as a furnace aperture or a hatch, of a wall surface to be cleaned.

17. A method according to claim 5, further comprising testing to determine whether the cleaning medium strikes the predetermined surface to be cleaned, and correcting said correlating when the cleaning medium fails to strike the pre-determined surface.

18. A method according to claim 5, wherein said correlating comprises entering at least one local condition parameter connected with the internal chamber selected from the group consisting of a pressure, a speed, a temperature, a mass flow, a composition, a variable characterising the material and a chemical variable.

19. A method according to claim 18, further comprising characterising an operating condition of the internal chamber of at least a part of an associated installation by means of the at least one condition parameter connected with the internal chamber, wherein the at least one condition parameter is selected from a capacity, a mass flow, a mill operation and a time or a time period.

20. A method according to claim 5, wherein said correlating comprises entering at least one parameter of the cleaning medium, wherein the at least one parameter of the cleaning medium is selected from a volume flow and a flow speed.

21. A method according to claim 5, wherein said correlating comprises entering at least one parameter of the blower lance, wherein the at least one parameter of the blower lance is a value representing a nozzle of the blower lance for the cleaning medium.

22. A controllable blower lance for cleaning a heatable internal chamber, in which deposits form, with a cleaning medium which strikes a surface to be cleaned in the internal chamber, said blower lance comprising:

a programmable control of the blower lance; and a storage which memorises at least one correlation for planned cleaning of the surface to be cleaned dependent upon at least one condition in the internal chamber.

23. A controllable blower lance according to claim 22, further comprising a controllable positioner of a delivery direction of the cleaning medium in the internal chamber.

24. A controllable blower lance according to claim 22, further comprising a regulator of the cleaning medium.

25. A controllable blower lance according to claim 22, further comprising a determinator of an impact point of the cleaning medium on the surface to be cleaned and/or a position of a part of the blower lance, and further comprising a recorder of the impact point of the cleaning medium on the surface to be cleaned and/or the position of a part of the blower lance.

26. A controllable blower lance according to claim 22, further comprising a sensor of at least one parameter concerning the conditions in the internal chamber, wherein the at least one parameter is selected from a loading state, the cleaning medium and an installation to which the internal chamber is connected.

27. A controllable blower lance according to claim 22, further comprising a recorder of cleaning carried out, an evaluator of cleaning carried out, and a controller of a following cleaning operation.

28. A controllable blower lance according claim 22, further comprising a regulator of the impact of the cleaning medium on the surface to be cleaned.

* * * * *